United States Patent [19]

Zorini

[11] Patent Number: 4,835,990

[45] Date of Patent: Jun. 6, 1989

[54] PULLING DEVICE FOR WARP YARNS IN CROCHET GALLOON LOOMS

[75] Inventor: Luigi O. Zorini, Cilavegna, Italy

[73] Assignee: COMEZ, S.p.A., Cilavegna, Italy

[21] Appl. No.: 229,218

[22] Filed: Aug. 5, 1988

[30] Foreign Application Priority Data

Oct. 13, 1987 [IT] Italy ..... 22260 A/87

[51] Int. Cl.[4] ..... D04B 27/10

[52] U.S. Cl. ..... 66/209; 66/210

[58] Field of Search ..... 66/203, 210, 209

[56] References Cited

U.S. PATENT DOCUMENTS

| | | | |
|---|---|---|---|
| 2,932,181 | 4/1960 | MacCaffray | 66/210 |
| 3,015,871 | 1/1962 | Noe | 66/210 X |
| 4,584,853 | 4/1986 | Lueger | 66/203 |

*Primary Examiner*—Ronald Feldbaum

*Attorney, Agent, or Firm*—Laff, Whitesel, Conte & Saret

[57] ABSTRACT

The device herein described comprises a pair of pulling rollers 3 which engage a manufactured article 4 produced by knitting members 5 acting upstream of the pulling rollers themselves, in order to interlace weft yarns with warp yarns 4*a*. A first driving mechanism 6 connects the pulling rollers 3 to a rotating main shaft 7, so that the pulling rollers too are rotated in order to pull the manufactured article apart from the knitting members during the operation of the loom. The device further comprises feed rollers 17, 18 rotated by a second driving mechanism 22 connecting them to the first driving mechanism. Feed rollers 17, 18 act upstream of the knitting members, upon the warp yarns 4*a* to move them forward towards the knitting members 5 and give them an appropriate tensioning.

2 Claims, 1 Drawing Sheet

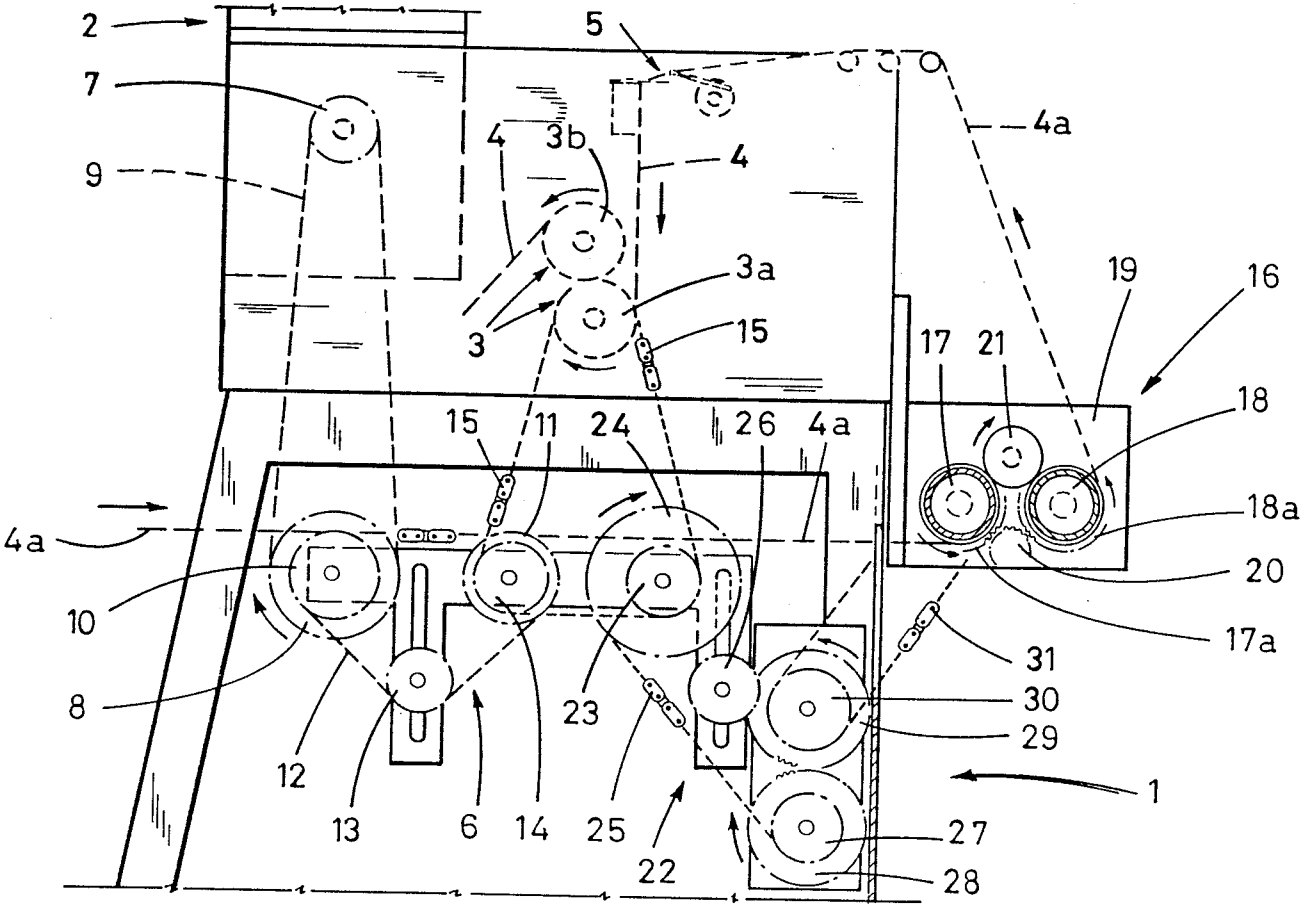
16
18
18a
20
17a
19
1
4a
21
31
30
29
17
27
28
4a
26
3a
15
4
22
5
24
23
25
3b
11
14
4
3
15
6
13
12
2
7
9
10
8
4a

PULLING DEVICE FOR WARP YARNS IN CROCHET GALLOON LOOMS

BACKGROUND OF THE INVENTION

1. Field of the Invention

The present invention relates to a pulling device for warp yarns in crochet galloon looms of the type comprising a main shaft operated in rotation, at least a pair of pulling rollers engaging a manufactured article downstream of knitting means designed to produce said manufactured article by interlacing weft yarns with warp yarns, and at least a first driving mechanism transmitting the rotatory motion of the main shaft to the pulling rollers.

2. Prior Art

It is known that in crochet galloon looms the pulling of the warp yarns is conventionally performed by means of pulling rollers acting downstream of the knitting means on the manufactured article they have produced. In greater detail pulling rollers rotated to an appropriate speed engage the manufactured article so as to move it apart from the knitting means as the manufactured article is being produced.

Due to the fact that the manufactured article is moved away from the knitting means the warp yarns are pulled along towards the knitting means to be interlaced with the weft yarns, being acted upon by said knitting means as the production of the article is going on.

For the purpose of performing a regular knitting it is of the greatest importance that the warp yarns should be submitted to a constant and appropriate tensioning. Said tensioning is presently accomplished by means of specific members individually engaging the warp yarns upstream of the loom and sometimes by the use of driving devices disposed upstream of the knitting means. Each tensioning member is substantially arranged so as to submit the respective warp yarn to a forced passage between two dish-shaped elements resting upon each other. While the yarn is sliding a frictional force is generated between the yarn and the dish-shaped element, which force counteracts the action of the pulling rollers giving the yarn the appropriate tensioning.

The pulling of the warp yarns carried out on the basis of the known art gives rise to several problems.

One of them is due to the fact that the frictional force counteracting the pulling of the yarns and, as a result, the extent of the warp tensioning, can vary if impurities are laid down on the tensioning members or any other member designed to guide the yarns. Even if a minimum variation in tensioning occurs, an irregular knitting is produced, which involves defects in the manufactured product. In order to avoid the above mentioned drawback it is presently necessary to submit the take-up members and all elements designed to guide the yarns to cleaning and servicing operations at predetermined time intervals and obviously said operatons involve long down times.

Systems of the known art also suffer the disadvantage that if the operation of the loom stops, the tensioning of the yarns is subjected to be completely altered once the loom is started again.

In greater detail, when the loom is operated anew, the warp yarns are for a short time subjected to a tensioning higher than that of a normal operation. This is due to the fact that in order to restore the normal sliding of the warp yarns, it is necessary to overcome static frictions existing between the yarns and the elements on which they slide. These static frictions are higher than the dynamic frictions which can be found during a normal operation and consequently involve an excessive tensioning of the yarns resulting in structural defects of the finished product.

SUMMARY OF THE INVENTION

The main object of the present invention is to solve the drawbacks of the known art by providing a pulling device capable of keeping a constant tensioning of the warp yarns under every situation even in the event that the operation of the loom is stopped and/or impurities are accumulated in the region of the take-up members and the elements adapted to guide the warp yarns.

The foregoing and further objects which will become more apparent in the course of the present description are substantially attained by a pulling device for warp yarns in crochet galloon looms comprising a feed unit acting upstream of the knitting means and including at least two feed rollers which engage the warp yarns and are taken in rotation by a second driving mechanism connected to the first driving mechanism.

BRIEF DESCRIPTION OF THE DRAWING

Further features and advantages will best be understood from the detailed description of a preferred embodiment of a pulling device for warp yarns in crochet galloon looms in accordance with the present invention, given hereinafter by way of non-limiting example with reference to the accompanying drawings in which the only figure is a diagrammatic side view of the device of the invention associated with a crochet galloon loom.

DESCRIPTION OF THE PREFERRED EMBODIMENT

Referring to the drawing, a pulling device for warp yarns in crochet galloon looms in accordance with the present invention has been globally identified by reference numeral 1.

The device 1 is associated with a crochet galloon loom known per se and conventional, referenced by 2 and only schematically shown. Said device comprises a pair of pulling rollers 3 engaging a manufactured article 4 which is being worked and is produced by knitting means 5 conventionally provided in the loom and substantially acting so as to interlace weft yarns not shown with warp yarns 4*a*, upstream of said pulling rollers.

In greater detail, provision is made for a first pulling roller 3*a* which is rotated to an appropriate speed by a first driving mechanism 6 connected to a main shaft 7 in turn rotated by a motor (not shown).

In the embodiment shown the first driving mechanism 6 comprises a first gear wheel 8 connected to the main shaft 7 by a first gear chain 9 or the like. Coaxially associated with the first gear wheel 8 is a second gear wheel 10 connected to a third gear wheel 11 by a second chain 12 which is kept tensioned by a takeup pulley 13. A fourth gear wheel 14 coaxially meshing with the third wheel 11 transmits a rotatory motion to the first pulling roller 3*a* by means of a third chain 15.

A second pulling roller 3*b* is conventionally urged against the first pulling roller 3*a*, for the purpose of ensuring the pulling of a fabric 4 which has been previously interposed therebetween.

In an original manner, the device of the invention is advantageously also provided with a feed unit globally identified by reference numeral 16 and comprising at least a first feed roller 17 and a second feed roller 18 operated in rotation and engaging the warp yarns 4*a* so as to send them towards the knitting members 5.

In the embodiment shown feed rollers 17 and 18 rotatably carried by a supporting structure 19 fastened to the frame of loom 2, extend in a horizontal direction according to parallel axes and are provided with respective gear wheels 17*a*, 18*a* operatively connected through a sprocket wheel 20. Also resting on feed rollers 17, 18 is a pressure roller 21. The warp yarns 4*a* coming from respective reels suitably supported by conventional members not shown, are engaged, at locations disposed in side by side relationship, about the first feed roller 17, pressure roller 21, and second feed roller 18 to be then sent to the knitting members 5. Due to the weight of pressure roller 21, warp yarns 4*a* are urged against the surfaces of feed rollers 17, 18 in the region in which the latter are in contact with said pressure roller.

Associated with the feed unit 16 is a second driving mechanism globally identified by reference numeral 22 and operatively connecting feed rollers 17, 18 to the first driving mechanism 6 and consequently to pulling rollers 3.

In the embodiment shown the second driving mechanism 22 is provided with a fifth gear wheel 23 operatively engaged with chain 15 and coaxially meshing with a sixth gear wheel 24. The gear wheel 24 is connected, via a fourth gear chain 25 tensioned by a second takeup pulley 26, to a seventh gear wheel 27. Coaxially coupled to the latter is an eighth gear wheel 28 meshing with a ninth wheel 29. A tenth gear wheel 30 coupled to wheel 29 is operatively connected to the first feed roller 17 through a fifth gear chain 31 or the like.

During the normal operation of the loom, the warp yarns 4*a* are simultaneously submitted to the action of the feed unit 16 and pulling rollers 3. Advantageously, the structure and sizes of the different components of the second driving mechanism 22 enable the feed rollers 17, 18 to be rotated to such a peripheral speed, depending upon the peripheral speed of pulling rollers 3, that an appropriate and constant tensioning of the warp yarns 4*a* is caused in the length included between the feed roller 16 and said pulling rollers.

In the connection it is to be pointed out that the peripheral speed of feed rollers 17, 18 can be slightly lower or higher than, or equal to, the speed of pulling rollers 3, depending upon the type of material to be worked and the type of knitting.

In operation changes in the warp yarn tensioning can be produced for example as a result of impurities laid down on the take-up members or on elements designed to guide said yarns. Advantageously these tensioning changes are restricted to the yarn length upstream of the feed unit 16; in fact, due to the engagement of the warp yarns 4*a* carried out by feed rollers 17, 18 and pressure roller 21, said tensioning changes cannot be transmitted to the yarn length included between the feed unit 16 and pulling rollers 3.

Therefore the knitting members 5 can act on warp yarns which constantly have the best tensioning conditions.

Due to the presence of feed unit 16, tensioning changes of the warp yarns are also prevented, still with reference to the length in the vicinity of the knitting members 5, even in the event of a possible stopping in the operation of the loom. In this case too in fact warp yarns 4*a* would remain taut due to their engagement between the pulling rollers 3 and feed rollers 17, 18 in cooperation with pressure roller 21. In particular it is to be pointed out that, due to the arrangement of pressure roller 21, the forces generated by the warp yarn tensioning cause said pressure roller 21 to be urged against feed rollers 17, 18 so as to eliminate any possibility of accidental sliding of the warp yarns between said rollers.

The present invention attains the intended purposes.

The constant tensioning of the warp yarns achieved by means of the present device brings about an advantageous elimination of working defects due to the presence of dust or impurities on the take-up member and guide members engaging said warp yarns upstream of the loom. It is therefore possible to remarkably reduce the servicing operations necessary to keep said members clean.

As is apparent from the above description, the present invention also allows the elimination of structural defects in the manufactured article thus produced, which may result from possible stoppings of the loom in operation.

Obviously the present invention is susceptible of many modifications and variations, all falling within the scope of the invention idea characterizing it.

What is claimed is:

1. A pulling device for warp yarns in crochet galloon looms comprising a main shaft operated in rotation, at least a pair of pulling rollers engaging a manufactured article downstream of knitting means designed to produce said manufactured article by interlacing weft yarns with warp yarns and at least a first driving mechanism transmitting the rotatory motion of the main shaft to the pulling rollers, wherein said device further comprises a feed unit disposed upstream of the knitting means and including at least two feed rollers which engage said warp yarns and are taken in rotation by a second driving mechanism connected to the first driving mechanism in order to give an appropriate and constant tensioning to the warp yarns in the length thereof disposed between said pulling rollers and feed units.

2. The pulling device as claimed in claim 1, wherein said feed unit comprises first and second feed rollers disposed parallelly in a horizontal direction, on which a pressure roller rests, said warp yarns being sequentially engaged about the first feed roller, the pressure roller and the second feed roller.

* * * * *